US011565775B1

(12) United States Patent
Strom

(10) Patent No.: US 11,565,775 B1
(45) Date of Patent: Jan. 31, 2023

(54) DIVER'S FLOATING MARKER ASSEMBLY

(71) Applicant: Lawrence Strom, McConnells, SC (US)

(72) Inventor: Lawrence Strom, McConnells, SC (US)

( * ) Notice: Subject to any disclaimer, the term of this patent is extended or adjusted under 35 U.S.C. 154(b) by 23 days.

(21) Appl. No.: 17/347,641

(22) Filed: Jun. 15, 2021

(51) Int. Cl.
*B63B 22/16* (2006.01)
*B63B 22/04* (2006.01)

(52) U.S. Cl.
CPC ..... *B63B 22/16* (2013.01); *B63B 22/04* (2013.01)

(58) Field of Classification Search
CPC ..... B63B 22/00; B63B 22/04; B63B 22/16; B63B 22/18; B63B 22/20; B63B 22/24; B63B 22/26
USPC ..... 441/6, 23, 24, 25, 26
See application file for complete search history.

(56) References Cited

U.S. PATENT DOCUMENTS 2,596,269 A 5/1952 Metzger
3,005,215 A * 10/1961 Colt ..... B63B 22/20 242/372
4,103,379 A 8/1978 Wolfe
5,231,952 A 8/1993 Tenniswood
5,360,359 A 11/1994 Reynolds
5,403,219 A * 4/1995 Ryan ..... B63B 22/00 441/89
5,782,663 A 7/1998 Van Raden
7,824,238 B1 * 11/2010 Winter ..... B63B 22/08 441/6
D674,306 S 1/2013 Ferguson
8,393,927 B1 * 3/2013 Schinke ..... B63B 22/16 441/23
2014/0261149 A1 9/2014 Amini

* cited by examiner

*Primary Examiner* — Daniel V Venne

(57) ABSTRACT

The diver's floating marker assembly is a marker buoy. The diver's floating marker assembly is configured for use in water. The diver's floating marker assembly is a safety device that marks an area in the water where one or more divers are operating. The diver's floating marker assembly is comprises a marker structure, a reel structure, and a tether. The tether attaches to the marker structure. The marker structure is a buoyant structure that visibly marks the area in the water where one or more divers are operating. The reel structure stores, pays out, and retracts the tether. The tether is paid out and retracted by the one or more divers while underneath the water. The use of the reel structure allows the position of the marker structure to be set by the one or more divers while underneath the water.

12 Claims, 5 Drawing Sheets

DIVER'S FLOATING MARKER ASSEMBLY

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of equipment for water-borne vessels and ships, more specifically, a buoy. (B63B22/18)

SUMMARY OF INVENTION

The diver's floating marker assembly is a marker buoy. The diver's floating marker assembly is configured for use in water. The diver's floating marker assembly is a safety device that marks an area in the water where one or more divers are operating. The diver's floating marker assembly comprises a marker structure, a reel structure, and a tether. The tether attaches to the marker structure. The marker structure is a buoyant structure that visibly marks the area in the water where one or more divers are operating. The reel structure stores, pays out, and retracts the tether. By stores is meant that the reel structure contains the tether when the diver's floating marker assembly is not in use. By pays out is meant that the tether is dispensed from the reel structure such that the span of the distance of the reel structure from the marker structure is increased. By retracted is meant that the tether is returned to the reel structure such that the distance of the reel structure from the marker structure is decreased. The tether is paid out and retracted by the one or more divers while underneath the water. The use of the reel structure allows the position of the marker structure to be set by the one or more divers while underneath the water.

These together with additional objects, features and advantages of the diver's floating marker assembly will be readily apparent to those of ordinary skill in the art upon reading the following detailed description of the presently preferred, but nonetheless illustrative, embodiments when taken in conjunction with the accompanying drawings.

In this respect, before explaining the current embodiments of the diver's floating marker assembly in detail, it is to be understood that the diver's floating marker assembly is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the diver's floating marker assembly.

It is therefore important that the claims be regarded as including such equivalent construction insofar as they do not depart from the spirit and scope of the diver's floating marker assembly. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
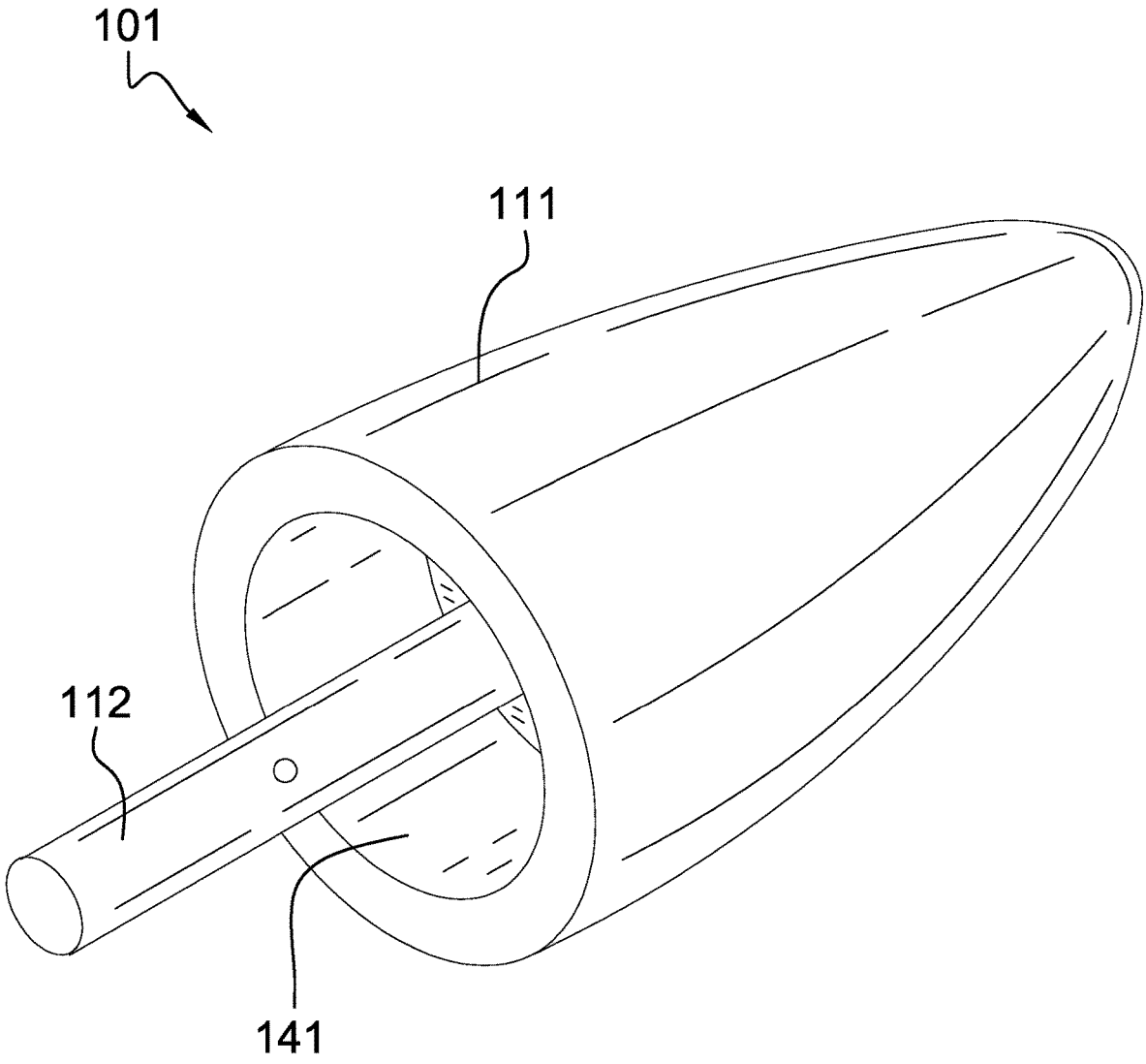
FIG. 1 is a perspective view of an embodiment of the disclosure.
Figure 2:
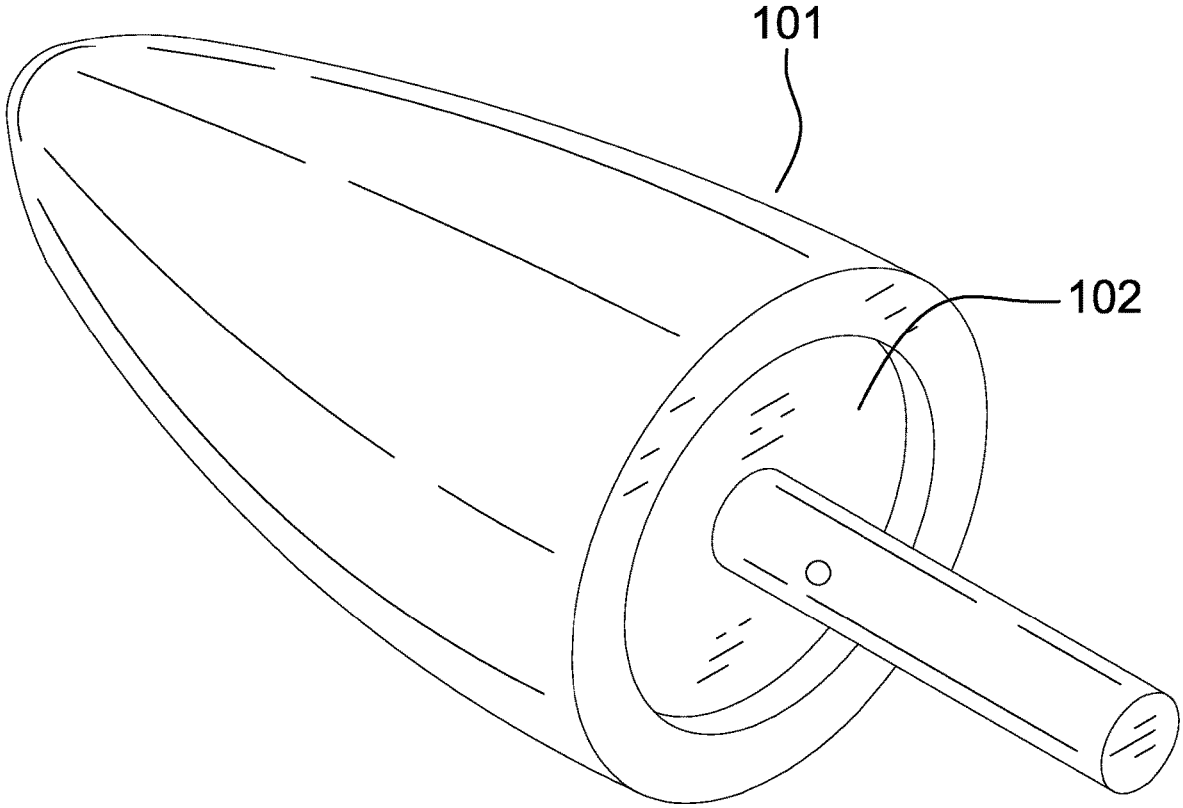
FIG. 2 is a reverse perspective view of an embodiment of the disclosure.
Figure 3:
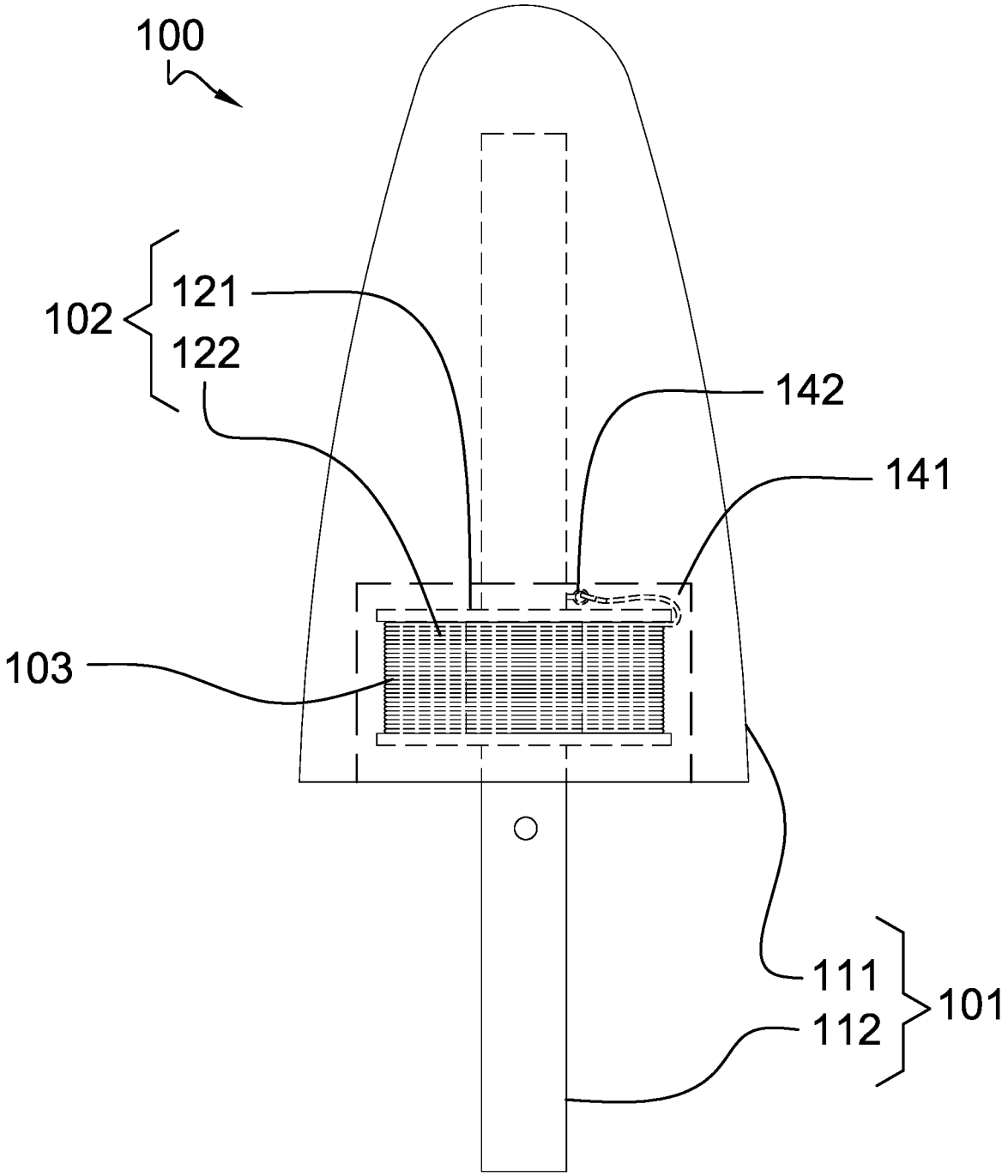
FIG. 3 is a front view of an embodiment of the disclosure.
Figure 4:
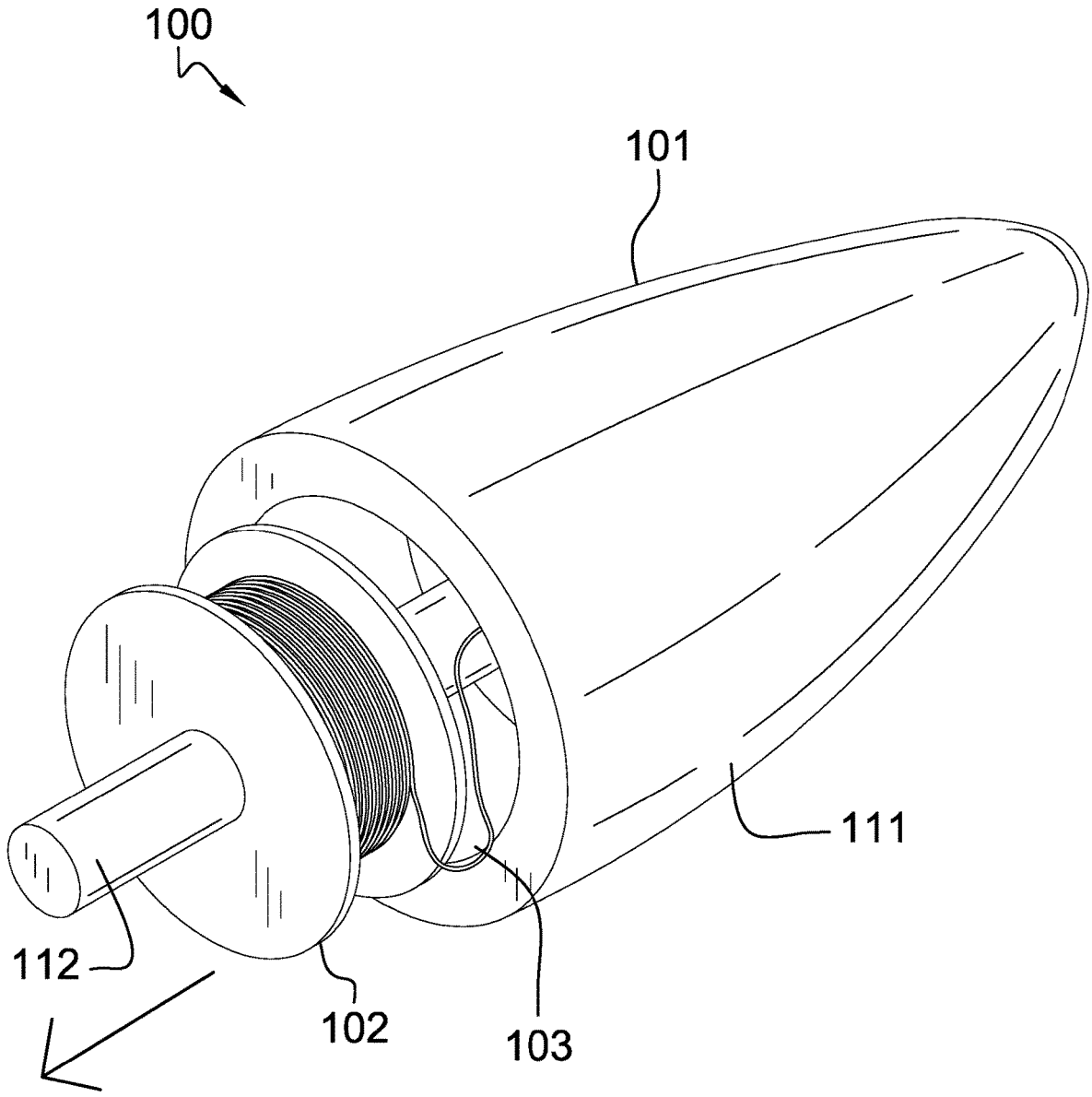
FIG. 4 is an in-use view of an embodiment of the disclosure.
Figure 5:
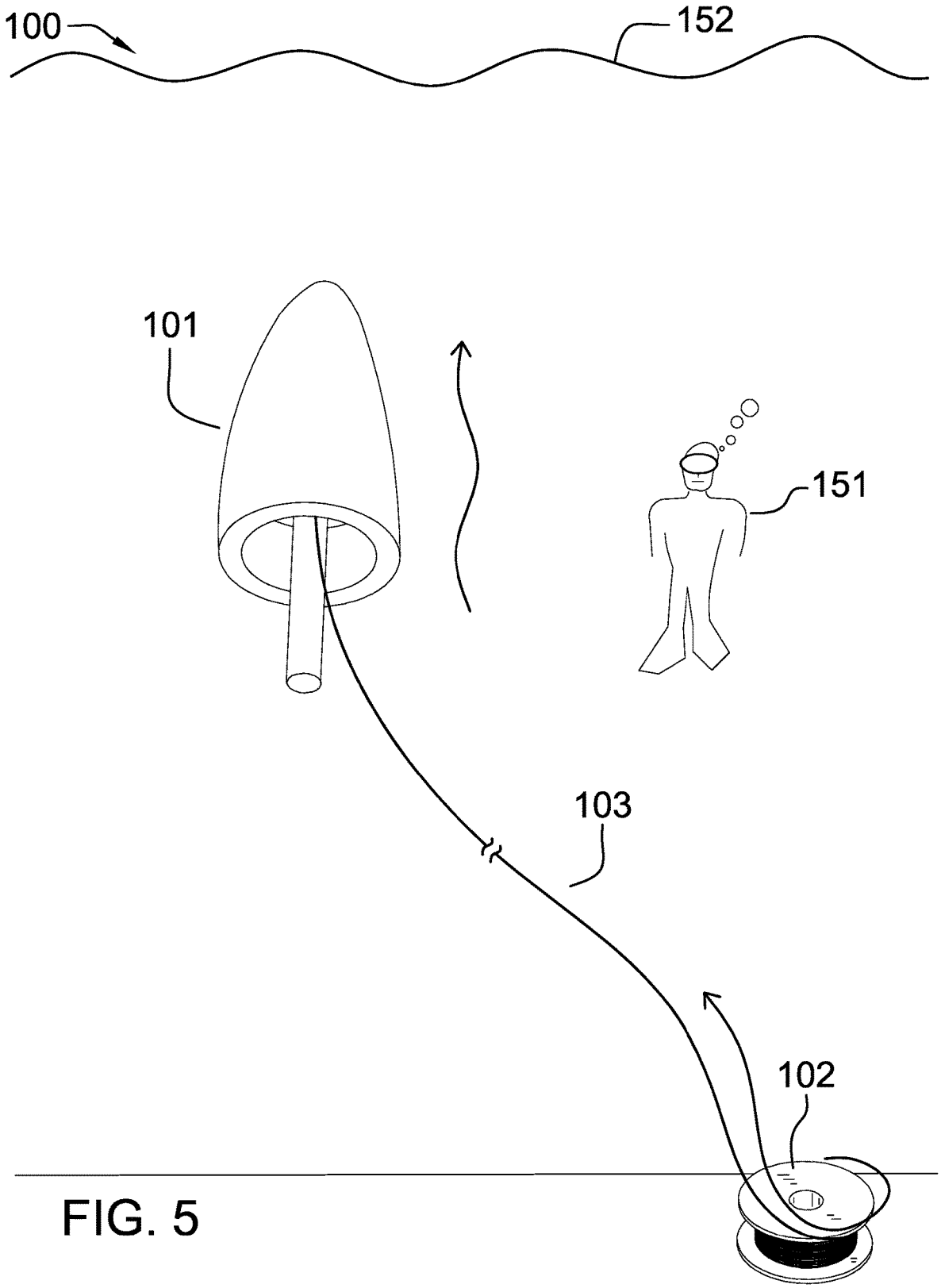
FIG. 5 is an in-use view of an embodiment of the disclosure.

Detailed reference will now be made to one or more potential embodiments of the disclosure, which are illustrated in FIGS. 1 through 5.

The diver's floating marker assembly 100 (hereinafter invention) is a marker buoy. The invention 100 is configured for use in water 152. The invention 100 is a safety device that marks an area in water 152 where one or more divers 151 are operating. The invention 100 comprises a marker structure 101, a reel structure 102, and a tether 103. The tether 103 attaches to the marker structure 101. The marker structure 101 is a buoyant structure that visibly marks the area in water 152 where one or more divers 151 are operating. The reel structure 102 stores, pays out, and retracts the tether 103. By stores is meant that the reel structure 102 contains the tether 103 when the invention 100 is not in use. By pays out is meant that the tether 103 is dispensed from the reel structure 102 such that the span of the distance of the reel structure 102 from the marker structure 101 is increased. By retracted is meant that the tether 103 is returned to the reel structure 102 such that the distance of the reel structure 102 from the marker structure 101 is decreased. The tether 103 is paid out and retracted by the one or more divers 151 while underneath the water 152. The use of the reel structure 102 allows the position of the marker structure 101 to be set by the one or more divers 151 while underneath the water 152.

The marker structure 101 is a buoyant structure. The marker structure 101 forms the visible marker that indicates that one or more divers 151 are in the water 152. The tether 103 and the reel structure 102 anchors the marker structure 101 to the water 152 bed. The marker structure 101 forms a storage space that contains the reel structure 102. The marker structure 101 comprises a cone 111 and a shaft 112.

The cone 111 is a prism-shaped structure. The cone 111 has a tapered prism shape. The cone 111 is a buoyant structure. The cone 111 forms the visible marker that indicates that one or more divers 151 are in the water 152. The reel structure 102 inserts into the cone 111 for storage. Specifically, the reel structure 102 inserts into the congruent end of the tapered prism structure of the cone 111 with the greatest surface area. The cone 111 further comprises a reel recess 141.

The reel recess 141 is a negative space that is formed in the cone 111. The reel recess 141 is formed in the congruent end of the tapered prism structure of the cone 111 with the greatest surface area. The reel recess 141 is a prism-shaped structure. The reel recess 141 is a disk-shaped structure. The reel recess 141 is formed in the cone 111 such that the cone 111 and the reel recess 141 form a composite prism structure. The reel recess 141 is geometrically similar to the reel structure 102 such that the reel structure 102 inserts into the reel recess 141 for storage.

The shaft 112 is a prism-shaped structure. The shaft 112 is a rigid structure. The shaft 112 attaches into the congruent end of the tapered prism structure of the cone 111 with the greatest surface area. The shaft 112 weights the cone 111 such that the center of mass of the marker structure 101 falls below the water 152 surface such that the tapered end of the prism structure of the cone 111 projects above the surface of the water 152. The shaft 112 inserts through the reel structure 102 such that the shaft 112 secures the reel structure 102 to the marker structure 101 when the reel structure 102 is in storage. The tether 103 attaches to the shaft 112. The shaft 112 attaches to the cone 111 such that the cone 111 and the shaft 112 form a composite prism structure. The shaft 112 further comprises a tether 103 anchor point 142.

The tether 103 anchor point 142 is a mechanical structure. The tether 103 anchor point 142 is a ring that is formed on the lateral face of the prism structure of the shaft 112. The tether 103 ties off onto the tether 103 anchor point 142 to secure the tether 103 to the marker structure 101.

The reel structure 102 is a mechanical structure. The reel structure 102 forms a storage structure that contains the tether 103. The tether 103 is paid out from the reel structure 102 by the one or more divers 151 when the one or more divers 151 are in the water 152. The tether 103 is retracted onto the reel structure 102 by the one or more divers 151 when the one or more divers 151 are in the water 152. By paying out and retracting the tether 103 from the reel structure 102 while the one or more divers 151 are in the water 152 allows the one or more divers 151 to more precisely position the marker structure 101 on the surface of the water 152.

The reel structure 102 mounts in the marker structure 101 when the tether 103 is fully retracted onto the reel structure 102. The reel structure 102 anchors the marker structure 101 and the tether 103 to the water 152 bed when the tether 103 is paid out from the reel structure 102. The reel structure 102 comprises a spool 121 and a shaft 112 aperture 122.

The spool 121 is a prism-shaped structure. The spool 121 is a disk-shaped structure. The spool 121 is formed with an open lateral face. The spool 121 is defined elsewhere in this disclosure. The tether 103 is wound onto the spool 121 during the retraction process. The tether 103 is drawn off the spool 121 during the pay out process. The spool 121 is geometrically similar to the reel recess 141 of the cone 111. The spool 121 inserts into the reel recess 141 to store the spool 121 in the cone 111. The spool 121 inserts into the reel recess 141 to form a composite prism structure.

The shaft 112 aperture 122 is a tubular structure. The shaft 112 aperture 122 is a rigid structure. The shaft 112 aperture 122 forms the center axis of the disk structure of the spool 121. The negative space formed by the shaft 112 aperture 122 is geometrically similar to the shaft 112 such that the shaft 112 inserts through the shaft 112 aperture 122 when the spool 121 inserts into the reel recess 141 of the cone 111.

The tether 103 is a cord. The tether 103 is secured to the marker structure 101. The tether 103 is further secured to the reel structure 102. The tether 103 spools onto the spool 121 of the reel structure 102. The tether 103 retracts onto the spool 121 of the reel structure 102 for storage. The tether 103 is paid out from the spool 121 of the reel structure 102 to anchor the marker structure 101 to the water 152 bed. In the first potential embodiment of the disclosure, the tether 103 attaches to the tether 103 anchor point 142 of the shaft 112 of the marker structure 101.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Anchor: As used in this disclosure, anchor means to hold an object firmly or securely.

Anchor Point: As used in this disclosure, an anchor point is a location to which a first object can be securely attached to a second object.

Bed: As used in this disclosure, a bed refers to the ground that forms the bottom of a body of water. Ground that is temporarily submerged under water is referred to as a flood bed.

Buoy: As used in this disclosure, a buoy is a floating structure that is anchored into position in water. A buoy is used for marking a location and for assisting an object to float.

Buoyancy: As used in this disclosure, buoyancy refers to a property of an object that floats in a liquid. The object that floats in the liquid is referred to as buoyant. Buoyancy specifically refers to the situation where the mass of the liquid that is displaced when a buoyant object is placed in the liquid is greater than the mass of the object itself. In this instance, the pressure of the displaced liquid will raise the buoyant object such that the buoyant object floats.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Center of Mass: As used in this disclosure, the center of mass refers to a point within a structure wherein a force applied to the point will cause the structure to move without rotation. The center of mass is commonly, but not always, the first moment of the structure normalized by the mass of the structure. While there are technical differences, the center of gravity of an object can be considered a synonym for the center of mass when the object is contained within the atmosphere of the earth.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Cord: As used in this disclosure, a cord is a long, thin, flexible, and prism shaped string, line, rope, or wire. Cords are made from yarns, piles, or strands of material that are braided or twisted together or from a monofilament (such as fishing line). Cords have tensile strength but are too flexible to provide compressive strength and are not suitable for use in pushing objects. String, line, cable, yarn, and rope are synonyms for cord.

Correspond: As used in this disclosure, the term correspond is used as a comparison between two or more objects wherein one or more properties shared by the two or more objects match, agree, or align within acceptable manufacturing tolerances.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Loop: As used in this disclosure, a loop is the length of a first linear structure including, but not limited to, shafts, lines, cords, or webbings, that is: 1) folded over and joined at the ends forming an enclosed space; or, 2) curved to form a closed or nearly closed space within the first linear structure. In both cases, the space formed within the first linear structure is such that a second linear structure such as a line, cord or a hook can be inserted through the space formed within the first linear structure. Within this disclosure, the first linear structure is said to be looped around the second linear structure.

Major and Minor Axes: As used in this disclosure, the major and minor axes refer to a pair of perpendicular axes that are defined within a structure. The length of the major axis is always greater than or equal to the length of the minor axis. The major axis is always the longest diameter of the structure. The major and minor axes intersect at the center of the structure. The major axis is always parallel to the longest edge of a rectangular structure.

Negative Space: As used in this disclosure, negative space is a method of defining an object through the use of open or empty space as the definition of the object itself, or, through the use of open or empty space to describe the boundaries of an object.

Not Significantly Different: As used in this disclosure, the term not significantly different compares a specified property of a first object to the corresponding property of a reference object (reference property). The specified property is considered to be not significantly different from the reference property when the absolute value of the difference between the specified property and the reference property is less than 10.0% of the reference property value. A negligible difference is considered to be not significantly different.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of prism structure of the pan and/or a portion of the closed lateral faces of the pan is are open.

Perimeter: As used in this disclosure, a perimeter is one or more curved or straight lines that bounds an enclosed area on a plane or surface. The perimeter of a circle is commonly referred to as a circumference.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Recess: As used in this disclosure, a recess is a disk-shaped negative space that is formed at the congruent end of prism-shaped structure. The recess is positioned relative to the congruent end of prism-shaped structure to form a composite prism negative space structure. The recess is sized to receive an object such that the object is below the plane of the surface in which the recess is formed.

Rigid Structure: As used in this disclosure, a rigid structure is a solid structure formed from an inelastic material that resists changes in shape. A rigid structure will permanently deform as it fails under a force. See bimodal flexible structure.

Ring: As used in this disclosure, a ring is term that is used to describe a disk-like structure through which a negative space is formed through the faces of the disk-like structure. Rings are often considered loops.

Roughly: As used in this disclosure, roughly refers to a comparison between two objects. Roughly means that the difference between one or more parameters of the two compared objects are not significantly different.

Spool: As used in this disclosure, a spool is a cylindrical device upon which a flexible material, including but not limited to a sheeting, yarn, a cord, or a tape, can be wound. Depending on context, a spool may also contain the flexible material stored upon the spool.

Taper: As used in this disclosure, a taper is a continuous and typically, but not necessarily gradual, change in the span of the length of a structure in the direction parallel a direction selected from the group selected from the major axis and the minor axis of the structure. The change in the span of the length occurs as an apparent function of the measurement position along the unselected axis of the object.

Tapered Prism Structure: As used in this disclosure, a tapered prism structure is a modified prism structure that is formed such that the first congruent end of the modified prism structure is geometrically similar to, but not geometrically identical to the second congruent end of the modified prism. The span of length of a radial line from the center axis to the lateral face of the modified prism structure will vary as a function of its position along the center axis. Always use taper.

Tether: As used in this disclosure, a tether is a cord, line, webbing, or strap that is attached to an object to restrict its movement.

Tube: As used in this disclosure, the term tube is used to describe a hollow prism-shaped device with two congruent open ends. While tubes that are suitable for use in this disclosure are often used to transport or conveys fluids or gases, the purpose of the tubes in this disclosure are structural. In this disclosure, the terms inner dimension and outer dimension of a tube are used as they would be used by those skilled in the plumbing arts.

Such As: As used in this disclosure, the term "such as" is a conjunction that relates a first phrase to a subsequent phrase. The term "such as" is used to introduce representative examples of structures that meet the requirements of the first phrase. As a first example of the use of the term "such as," the phrase: "the first textile attaches to the second textile using a fastener such as a hook and loop fastener" is taken to mean that a hook and loop fastener is suitable to use as the fastener but is not meant to exclude the use of a zipper or a sewn seam. As a second example of the use of the term "such as," the phrase: "the chemical substance is a halogen such as chlorine or bromine" is taken to mean that either chlorine or bromine are suitable for use as the halogen but is not meant to exclude the use of fluorine or iodine.

Such That: As used in this disclosure, the term "such that" is a conjunction that relates a first phrase to a subsequent phrase. The term "such that" is used to place a further limitation or requirement to the first phrase. As a first example of the use of the term "such that," the phrase: "the door attaches to the wall such that the door rotates relative to the wall" requires that the attachment of the door allows for this rotation. As a second example of the use of the term "such that," the phrase: "the chemical substance is selected such that the chemical substance is soluble in water" requires that the selected chemical substance is soluble in water. As a third example of the use of the term "such that," the phrase: "the lamp circuit is constructed such that the lamp circuit illuminates when the lamp circuit detects darkness" requires that the lamp circuit: a) detect the darkness; and, b) generate the illumination when the darkness is detected.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A diver's floating marker assembly comprising
a marker structure, a reel structure, and a tether;
wherein the tether attaches to the marker structure;
wherein the diver's floating marker assembly is a marker buoy;
wherein the diver's floating marker assembly is configured for use in water;
wherein the diver's floating marker assembly is a safety device that marks an area in water where one or more divers are operating;
wherein the marker structure is a buoyant structure that visibly marks the area in water where one or more divers are operating;
wherein the reel structure stores, pays out, and retracts the tether;
wherein by stores is meant that the reel structure contains the tether when the diver's floating marker assembly is not in use;
wherein by pays out is meant that the tether is dispensed from the reel structure such that the span of the distance of the reel structure from the marker structure is increased;
wherein by retracted is meant that the tether is returned to the reel structure such that the distance of the reel structure from the marker structure is decreased;

wherein the tether is paid out and retracted by the one or more divers while underneath the water;

wherein the marker structure is a buoyant structure;

wherein the marker structure forms the visible marker;

wherein the tether and the reel structure anchors the marker structure to the water bed;

wherein the marker structure forms a storage space that contains the reel structure.

2. The diver's floating marker assembly according to claim 1 wherein the reel structure is a mechanical structure;

wherein the reel structure mounts in the marker structure when the tether is fully retracted onto the reel structure;

wherein the reel structure anchors the marker structure and the tether to the water bed when the tether is paid out from the reel structure.

3. The diver's floating marker assembly according to claim 2 wherein the tether is a cord;

wherein the tether is secured to the marker structure;

wherein the tether is further secured to the reel structure.

4. The diver's floating marker assembly according to claim 3 wherein the marker structure comprises a cone and a shaft;

wherein the shaft attaches to the cone.

5. The diver's floating marker assembly according to claim 4 wherein the reel structure comprises a spool and a shaft aperture;

wherein the shaft aperture forms the center axis of the disk structure of the spool.

6. The diver's floating marker assembly according to claim 5 wherein the cone has a tapered shape;

wherein the cone is a buoyant structure;

wherein the cone forms the visible marker;

wherein the reel structure inserts into the cone for storage.

7. The diver's floating marker assembly according to claim 6 wherein the cone further comprises a reel recess;

wherein the reel recess is a negative space that is formed in the cone;

wherein the reel recess is formed in the congruent end of the tapered structure of the cone with the greatest surface area;

wherein the reel recess is a disk-shaped structure;

wherein the reel recess is formed in the cone such that the cone and the reel recess form a composite structure;

wherein the reel recess is geometrically similar to the reel structure such that the reel structure inserts into the reel recess for storage.

8. The diver's floating marker assembly according to claim 7 wherein the shaft is a rigid structure;

wherein the shaft attaches into the congruent end of the tapered structure of the cone with the greatest surface area;

wherein the shaft weights the cone such that the center of mass of the marker structure falls below the water surface such that the tapered end of the cone projects above the surface of the water;

wherein the shaft inserts through the reel structure such that the shaft secures the reel structure to the marker structure when the reel structure is in storage;

wherein the tether attaches to the shaft;

wherein the shaft attaches to the cone such that the cone and the shaft form a composite structure.

9. The diver's floating marker assembly according to claim 8 wherein the shaft further comprises a tether anchor point;

wherein the tether anchor point is a mechanical structure;

wherein the tether anchor point is a ring that is formed on the lateral face of the shaft;

wherein the tether ties off onto the tether anchor point to secure the tether to the marker structure.

10. The diver's floating marker assembly according to claim 9 wherein the spool is a disk-shaped structure;

wherein the spool is formed with an open lateral face;

wherein the tether is wound onto the spool during the retraction process;

wherein the tether is drawn off the spool during the pay out process;

wherein the spool is geometrically similar to the reel recess of the cone;

wherein the spool inserts into the reel recess to store the spool in the cone;

wherein the spool inserts into the reel recess to form a composite structure.

11. The diver's floating marker assembly according to claim 10 wherein the shaft aperture is a tubular structure;

wherein the shaft aperture is a rigid structure;

wherein the negative space formed by the shaft aperture is geometrically similar to the shaft such that the shaft inserts through the shaft aperture when the spool inserts into the reel recess of the cone.

12. The diver's floating marker assembly according to claim 11 wherein the tether spools onto the spool of the reel structure;

wherein the tether retracts onto the spool of the reel structure for storage;

wherein the tether is paid out from the spool of the reel structure to anchor the marker structure to the water bed;

wherein the tether attaches to the tether anchor point of the shaft of the marker structure.

* * * * *